US005944290A

United States Patent [19]

Fuhrmann et al.

[11] Patent Number: 5,944,290

[45] Date of Patent: Aug. 31, 1999

[54] ROTATIONALLY SECURED COLUMN

[75] Inventors: Castor Fuhrmann, Brachtendorf; Peter Thurmann, Waldesch, both of Germany

[73] Assignee: Stabilus GmbH, Koblenz, Germany

[21] Appl. No.: 08/895,463

[22] Filed: Jul. 16, 1997

[30] Foreign Application Priority Data

Jul. 17, 1996 [DE] Germany ..... 196 28 721

[51] Int. Cl.[6] ..... A47C 3/30

[52] U.S. Cl. ..... 248/161; 248/188.5; 248/404; 297/344.19

[58] Field of Search ..... 248/161, 404, 248/406.1, 418, 188.2, 188.5, 622, 631; 297/344.19

[56] References Cited

U.S. PATENT DOCUMENTS

| | | | |
|---|---|---|---|
| 3,004,743 | 10/1961 | Wenger | 248/161 |
| 4,061,304 | 12/1977 | Schattmaier | 248/404 |
| 4,415,135 | 11/1983 | French | 248/161 |
| 4,750,701 | 6/1988 | Folson et al. | 248/406.1 |
| 4,756,496 | 7/1988 | Hosan et al. | 248/161 |
| 4,842,238 | 6/1989 | Toiyama | 248/161 X |
| 5,031,869 | 7/1991 | Strater et al. | 248/406.1 |
| 5,284,312 | 2/1994 | Dony | 248/161 |
| 5,385,323 | 1/1995 | Garelick | 248/161 |
| 5,443,573 | 8/1995 | Thiele et al. | 248/161 X |
| 5,531,413 | 7/1996 | Wolf et al. | 248/404 X |

FOREIGN PATENT DOCUMENTS

| | | |
|---|---|---|
| 0366128 | 5/1990 | European Pat. Off. . |
| 1554216 | 4/1970 | Germany . |
| 4313766 | 11/1994 | Germany . |
| 4428259A1 | 2/1996 | Germany . |

*Primary Examiner*—Derek J. Berger
*Attorney, Agent, or Firm*—Baker & Botts, L.L.P.

[57] ABSTRACT

A vertically adjustable column, in particular for chairs or tables, includes a pedestal tube having a coaxially arranged lengthwise adjusting element, e.g., a gas spring, and a rotational fixation profile engaging a counterpart profile extending parallel to the longitudinal centerline of the pedestal tube. The rotational fixation profile and the counterpart profile are operatively arranged between the pedestal tube and the lengthwise adjusting element, and one of the profile parts is arranged in series with the lengthwise adjusting element.

5 Claims, 2 Drawing Sheets

ROTATIONALLY SECURED COLUMN

BACKGROUND OF INVENTION

The invention relates to a vertically adjustable column in particular for chairs or tables.

THE PRIOR ART

German DE 4,313,766 A1 describes a lengthwise adjustable column for chairs, tables or the like, having a pedestal tube comprising a pneumatic or hydropneumatic lengthwise adjusting element arranged therein whose housing is radially supported and displaceably guided in the direction of a common centerline. A rotational fixation profile is fixedly mounted, in particular by shrinking, on the housing, comprising at least one radially projecting spline engaging a groove-like recess in a guide rotationally fixed in relation to the pedestal tube.

Such columns are employed wherever a preassigned rotational position must be maintained without fail, for example, in furniture for school or conference purposes.

In the case of the column according to DE 4,313,766, the rotational fixation profile is necessarily visible in the extended position of the adjusting element. For visual reasons, this drawback is not always acceptable. Besides, the fixation of the profile support by shrinking is not without its problems. On the premise that a defined clearance must be maintained between the profile parts, tolerances must be very close. Furthermore, both the degree of shrinkage of the profile support and the tolerance on the outside diameter of the lengthwise adjusting element must be taken into account.

SUMMARY

It is an object of the present invention to overcome the foregoing and other disadvantages of the prior art.

This object is accomplished, according to the invention, in that one of the profile parts is arranged in series with the lengthwise adjusting element. A quite essential advantage is in that the profile parts are not visible. In addition, there is more radial space available for the lengthwise adjusting element.

Provision is made for the lengthwise adjusting element to comprise a power-assisted lift element sheathed by a support tube, the support tube comprising a rim at least partly encircling the lengthwise adjusting element, which rim is in operative connection with one of the profile parts. Consequently, the support tube need not be furnished with a profile, so that the lengthwise adjusting element and the profile part are strictly independent parts.

As an advantageous further feature, one of the profile parts takes the form of a stepped member having a plurality of apertures arranged in circumferential direction, so that partial indentations in the encircling rim of the support tube can be pressed into the apertures. Thus a rotation-proof connection is made between the lengthwise adjusting element and the profile part.

Preferably one face of the stepped member is in contact with the lengthwise adjusting element, the contour of said face being adapted to the configuration of the lengthwise adjusting element.

With a view to an exact radial positioning of the lengthwise adjusting element, the element is axially movable in a guide of the pedestal tube, which guide includes the counterpart profile.

Vertically adjustable columns used in practice may be made in distinctly different lengths. With a view to economy of guide types, in accordance with the invention the guide connects to an axial prolongation or extension which likewise carries a portion of the counterpart profile. Between an inside diameter of the prolongation, extending concentrically with the lengthwise adjusting element, and the adjusting element, there is a gap, so that the lengthwise adjusting element is radially positioned exclusively by the guide. A functional separation is obtained between the guide and the prolongation.

As another measure to reduce the multiplicity of parts, the prolongation is of multipartite or segmented construction, with a positive geometrical connection between the segments of the prolongation. The number of segments used will depend on the length of the column.

So that the prolongation will be positioned in axial direction as well, it is preferably placed under axial stress between the guide and the bottom wall of the pedestal tube.

BRIEF DESCRIPTION OF THE DRAWINGS

The invention will be illustrated in more detail by the following description of a representative embodiment thereof, with reference to the figures of the accompanying drawings, in which.

DETAILED DESCRIPTION

Figure 1:
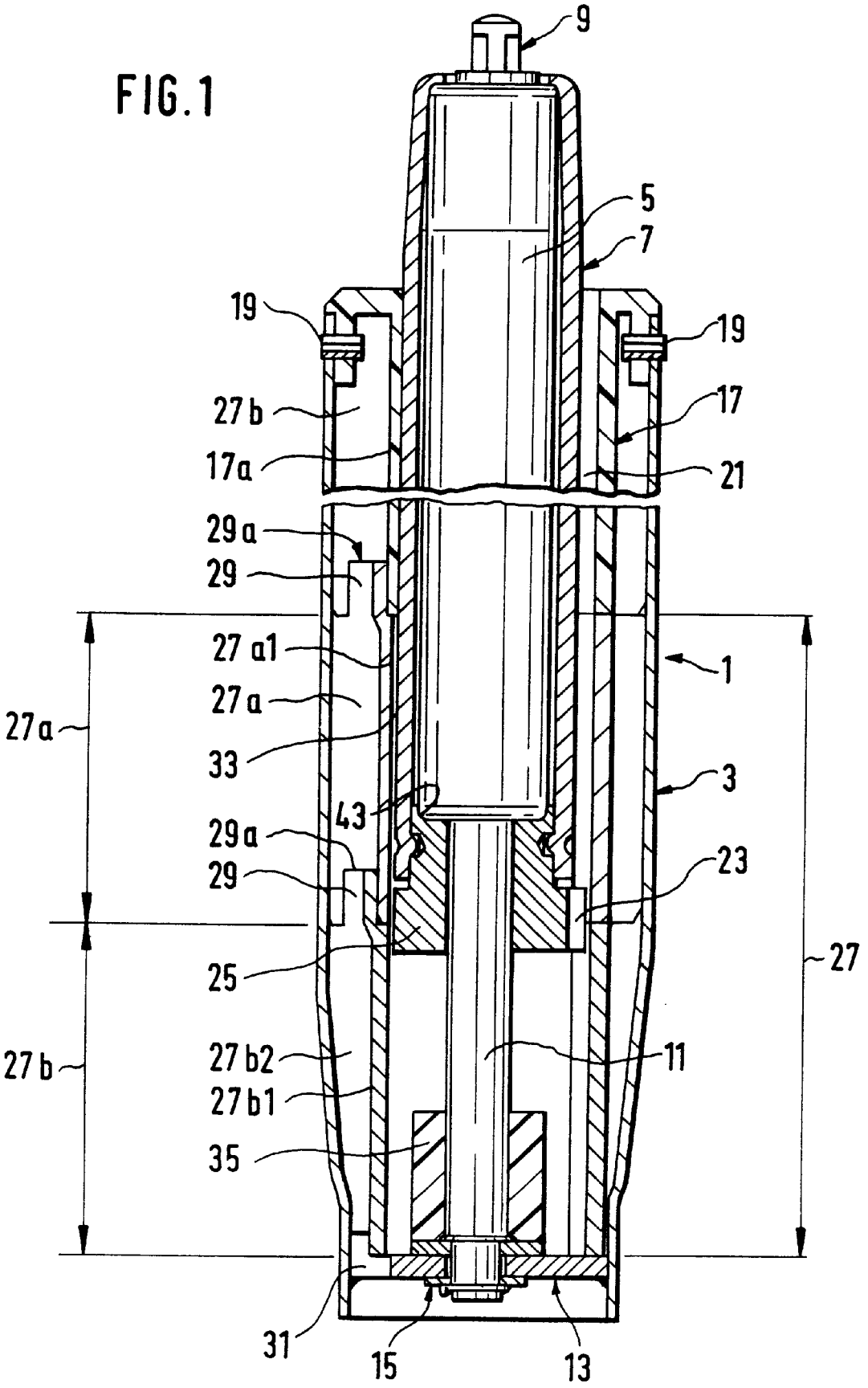
FIG. 1 is a longitudinal sectional view of one embodiment of the invention.

FIG. 1 shows a vertically adjustable column 1 such as is in common use for chairs, tabletops, or the like. An essential component consists of a pedestal tube 3 in which a lengthwise adjusting element 5 is coaxially arranged. Ordinarily, the lengthwise adjusting element consists of a gas spring, for example, as disclosed by DE 1,554,216 or EP 0,366,128 A1. Alternatively, however, a helical compression spring might be employed. The lengthwise adjusting element is sheathed over at least a portion of its length, e.g. the cylinder member of a gas spring, by a support tube 7 having an opening for a tappet 9. By means of the tappet, the gas spring may be blocked and unblocked at will, to permit or prohibit an action of extension of the gas spring. A piston rod 11 of the lengthwise adjusting element 5 rests on a bottom wall 13 of the pedestal tube. In the direction of tension, the piston rod is axially secured to the bottom wall 13 by means of a lock washer 15.

Radial positioning of the lengthwise adjusting element 5 within the pedestal tube 3 is provided by a guide 17 held in the circumferential direction by a positive connection in the form of pins 19 connected to the pedestal tube 3. Alternatively, indentations or the like between the tube 3 and the guide 17 may be employed. The guide 17 comprises a central cylindrical guiding wall 17*a* and a plurality of circumferential-spaced ribs or splines 17*b* which extend radially between the cylindrical wall 17*a* and the pedestal tube 3.

In the guide 17, one or more grooves 21 extending parallel to the longitudinal centerline of the vertically adjustable column are formed in the cylindrical guiding wall 17*a*, constituting a counterpart profile for a corresponding number of radial projections 23, constituting a rotational fixation profile, of a stepped member 25 arranged in series with the lengthwise adjusting element 5.

The guide 17 with its counterpart profile is axially shorter than the maximum lift of the lengthwise adjusting element 5. So that a rotation-proof lift action will nevertheless be ensured, an axial prolongation 27 follows upon the guide. This prolongation consists of a plurality of axial segments 27*a*, 27*b* having central cylindrical walls 27*a*1, 27*b*1 and radial ribs or splines 27*a*2, 27*b*2. The segments 27*a*, 27*b* are assembled to each other and to the guide 17 by means of positive geometrical connections, so that the counterpart profile 21 of the guide 17 is continued axially in the prolongation. For example, the geometrical connections between the segments 27*a*, 27*b* and between the segment 27*a* and the guide 17 may consist of axial ribs 29 engaging matching rib profiles 29*a*. Preferably, the complete prolongation 27 is axially stressed between the guide 17 and the bottom wall 13. For proper positioning of the lower segment 27*b*, the bottom wall 13 has at least one guide projection 31, especially in the case of a long chair column.

The segments 27*a*, 27*b* of the prolongation are so designed in relation to their inside diameter that there is a gap 33 between the support tube 7 and the central walls 27*a*1, 27*b*1 of the prolongation. Consequently, the guide 17 is solely responsible for radial positioning of the housing 7 and the lengthwise adjusting adjustable element 5.

A resilient bumper 35 may be arranged on the bottom wall 13, for resiliently limiting the movement of the lengthwise adjusting element 5 in the retracting direction.

Figure 2:
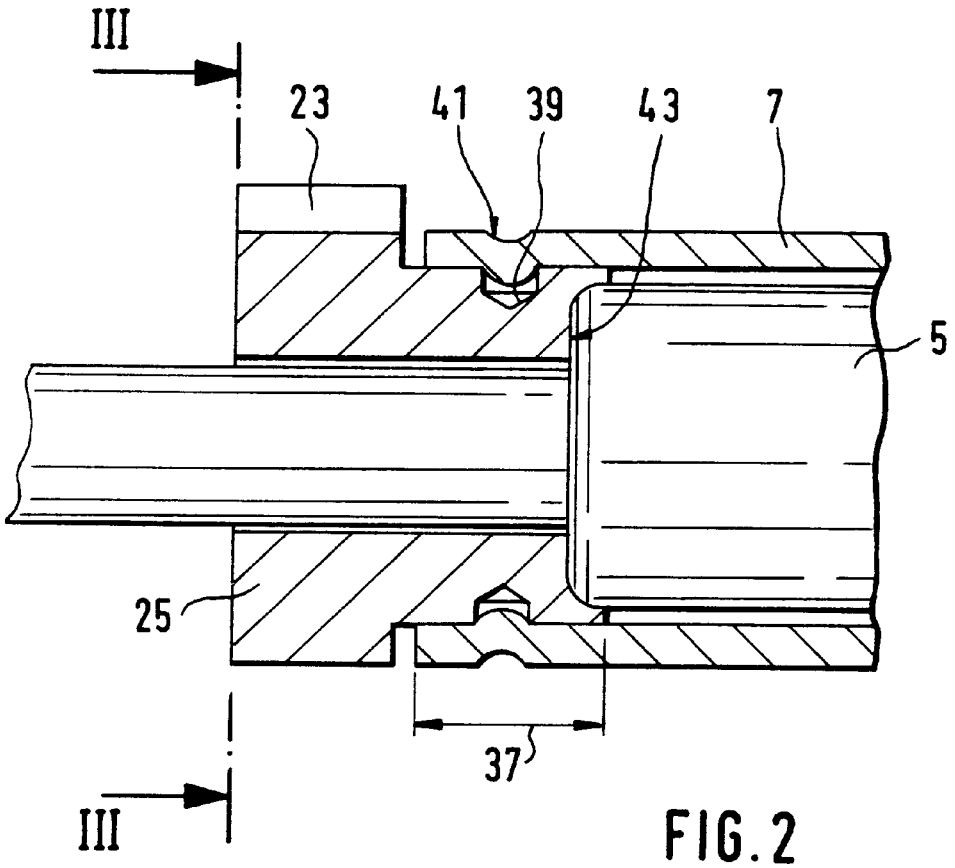
FIG. 2 is a detail view showing the connection between the stepped member and the lower rim of the support tube.
Figure 3:
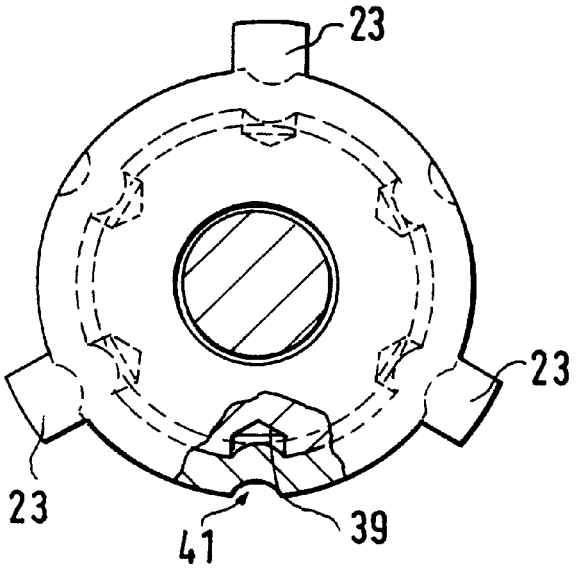
FIG. 3 is a sectional view taken along the line 3—3 in FIG. 2, with parts broken away for clarity.

FIGS. 2 and 3 show the structure of the stepped member 25 and the rotational fixation profile 23 in more detail. The stepped member 25 serving as profile part is mounted within a rim 37 at the lower end of the support tube 7 which at least partially encircles the member 25. Circumferentially spaced apertures 39 are formed in the surface of the member 25, and inwardly projecting indentations 41 re formed in the rim 37 so that a fixed connection in both the axial direction and the circumferential direction is established between the stepped member 25 and the lengthwise adjusting element 5. With a view to lending as much support as possible to the stepped member 25, the latter preferably has a face 43 adapted to the contour of the lower end of the lift element 5. As may be seen from FIG. 1, the axial position of the lengthwise adjusting element 5 in the support tube 7 is maintained by the face 43.

Although the invention has been described and illustrated by reference to specific embodiments thereof, it will be understood by those skilled in the art that such embodiments are susceptible of modification and variation without departing from the inventive concepts disclosed. All such modifications and variations, therefore, are intended to be encompassed within the spirit and scope of the appended claims.

We claim:

1. A vertically adjustable column, comprising:

a pedestal tube having an axis of elongation;

a lengthwise adjusting, power assisted lift element coaxially received within the pedestal tube and having an axially inner end located within said pedestal tube and an axially outer end located outside of said pedestal tube, said power assisted lift element being axially movable relative to the pedestal tube; and a support tube surrounding the power assisted lift element and having a circumferential rim which at least partly encircles the axially inner end of said power assisted lift element;

an annular stepped member having an axially outer face and a radially outer surface, said radially outer surface having a plurality of circumferentially spaced apertures formed therein;

a corresponding plurality of circumferentially spaced indentations formed in the circumferential rim of said support tube, said indentations being pressed into said apertures to secure the stepped member to the support tube;

means carried by the pedestal tube for defining a counterpart profile extending parallel to the axis of the pedestal tube;

at least one radial projection on the stepped member, said at least one radial projection being in operative engagement with said counterpart profile to permit axial movement of the power assisted lift element relative to the pedestal tube while preventing relative rotational movement therebetween.

2. A vertically adjustable column according to claim 1, wherein the axially outer face of the stepped member is in contact with the axially inner end of the power assisted lift element, said axially outer face of said stepped member having a contour that conforms at least in part to the contour of the axially inner end of the power assisted lift element.

3. A vertically adjustable column, comprising:

a pedestal tube having an axis of elongation, a closed axially inner end and an open axially outer end, a substantially cylindrical lengthwise adjusting element coaxially received within the axially outer end of the pedestal tube and having an axially inner end located within said pedestal tube and an axially outer end located outside of said pedestal tube, said lengthwise adjusting element being axially movable relative to said pedestal tube;

a tubular guide received in the open upper end of the pedestal tube for guiding axial movement of the lengthwise adjusting element relative to the pedestal tube;

means carried by the lengthwise adjusting element adjacent the axially inner end thereof for defining a profile for restraining rotation of the lengthwise adjusting element relative to said pedestal tube;

means carried by said guide for defining a counterpart profile extending parallel to the axis of the pedestal tube, the rotational restraining profile and the counterpart profile being operatively engaged to permit axial movement of the lengthwise adjusting element relative to the pedestal tube while preventing relative rotational movement therebetween; and means connected to the guide for axially extending the counterpart profile axially inwardly of the guide, said means for axially extending the counterpart profile comprising a cylindrical wall portion extending concentrically with the lengthwise adjusting element and having an internal diameter defining an annular gap with the external cylindrical surface of the lengthwise adjusting element, whereby said lengthwise adjusting element is radially positioned within the pedestal tube solely by said guide.

4. A vertically adjustable column according to claim 3, wherein said cylindrical wall portion comprises a plurality of axial segments arranged end to end, the adjacent ends of axially adjacent segments having mutually interlocking structure to establish a positive geometrical connection between said segments.

5. A vertically adjustable column according to claim 4, wherein said axial segments extend axially between the guide and the axially inner end of the pedestal tube and are under compressive force therebetween.

* * * * *

UNITED STATES PATENT AND TRADEMARK OFFICE

CERTIFICATE OF CORRECTION

PATENT NO. : 5,944,290

DATED : August 31, 1999

INVENTOR(S) : Castor Fuhrmann et al.

It is certified that error appears in the above-identified patent and that said Letters Patent is hereby corrected as shown below:

Column 3, claim 1, line 58: "and" should be deleted.

Column 4, claim 1, line 8: after "tube;" insert --and,--.

Signed and Sealed this

Sixth Day of February, 2001

*Attest:*

*Attesting Officer*

Q. TODD DICKINSON

*Director of Patents and Trademarks*